US005402211A

United States Patent [19]

Yoshikawa

[11] Patent Number: 5,402,211

[45] Date of Patent: Mar. 28, 1995

[54] HEATED FIXING ROLLER WITH SELECTIVELY HEATABLE PORTIONS

[75] Inventor: Takahiro Yoshikawa, Sagamihara, Japan

[73] Assignee: Ricoh Company, Ltd., Tokyo, Japan

[21] Appl. No.: 139,747

[22] Filed: Oct. 21, 1993

[30] Foreign Application Priority Data

Oct. 21, 1992 [JP] Japan ..... 4-307624
Jun. 25, 1993 [JP] Japan ..... 5-180934

[51] Int. Cl.[6] ..... G03G 15/20

[52] U.S. Cl. ..... 355/285; 219/216; 219/470; 219/471; 432/60

[58] Field of Search ..... 355/282, 285, 290; 219/216, 469, 470, 471; 432/60, 228

[56] References Cited

U.S. PATENT DOCUMENTS

| | | | |
|---|---|---|---|
| 4,266,115 | 5/1981 | Dannatt | 219/216 |
| 4,724,303 | 2/1988 | Martin et al. | 219/216 |
| 4,724,305 | 2/1988 | Iimura et al. | 219/469 |
| 4,743,940 | 5/1988 | Nagasaka et al. | 219/216 X |
| 4,801,968 | 1/1989 | Kogure et al. | 219/216 X |
| 5,081,340 | 1/1992 | Levitan | 219/469 |

FOREIGN PATENT DOCUMENTS

| | | | |
|---|---|---|---|
| 62-24288 | 2/1987 | Japan | 355/285 |
| 62-279377 | 12/1987 | Japan | 355/285 |
| 62-287277 | 12/1987 | Japan | 355/285 |

*Primary Examiner*—William J. Royer
*Attorney, Agent, or Firm*—Oblon, Spivak, McClelland, Maier & Neustadt

[57] ABSTRACT

A fixing roller device which is capable of dividing the heating area into a plurality of separately heatable different parts both in the circumferential direction of the heater roller, as well as in the direction parallel to the axis of the heater roller. As a result, the heating area can be varied according to various image fixing requirements, as well as for varying initial warm-up requirements. In addition, the temperature of the heating roller can be controlled by varying the density of heating chips or heating elements which are supplied with power within a heated area. Further, temperature control can also be accomplished utilizing a control arrangement based upon the current passing through the heater chips or heater elements, since the current varies with temperature, and thus external temperature sensors for monitoring the temperature of the fixing roller are not required.

21 Claims, 10 Drawing Sheets

HEATED FIXING ROLLER WITH SELECTIVELY HEATABLE PORTIONS

BACKGROUND OF THE INVENTION

1. Field of the Invention

The present invention relates to improvements in fixing devices for image forming apparatus, such as copying machines, printers, facsimile machines, etc. Such fixing devices fix a developer or toner image printed on a paper sheet utilizing a heating element.

2. Discussion of the Background

A conventional fixing device for a copying machine, printer, facsimile or the like is composed of a heating roller which heats a toner image on a paper sheet, a pressing roller disposed in contact with the heating roller, with a halogen lamp installed in the heating roller to thereby heat the heating roller from the inside thereof. In addition, a temperature fuse is disposed outside of the heating roller, with a first sensor sensing the temperature of the center of the outer periphery of the heating roller (the center of the printing area), and a second sensor arrangement sensing the temperatures of both side edges of the outer periphery of the heating roller (the edge portions of the printing area). However, with this conventional fixing roller, the fixing is achieved without regard to the minimum amount of heat or temperature required for a corresponding paper size, resulting in a waste of electrical energy. The fixing device is particularly inefficient since the halogen lamp heats all of the heating roller from the inside thereof, regardless of the size of the paper sheet having an image fixed thereon. Furthermore, an additional sensor arrangement is required particularly where small-sized paper sheets are fixed consecutively, in order to prevent the temperature at both of the side edge portions of the heating roller from rising extraordinarily or excessively. This results in an increase in the cost of the fixing device.

Another conventional fixing device, for example as described in Japanese Laid-Open Patent Application No. 3-291681 (see, e.g., FIG. 17), is composed of a plurality of heating wires, each of which can be independently supplied with power, with each disposed inside the corresponding heating roller portions one by one, and selectively supplied with electric power to heat a toner image on the paper sheet. A few different widths of the heated part can be provided corresponding to the size of the paper sheet to be fixed. However, it is not possible to vary the heating area, or to divide the heating area into only required or desired areas or parts in the direction parallel to the axis of the heating roller, or into plural areas or parts in the circumferential direction of the heating roller. Accordingly, it is not possible to change heating widths in the direction parallel to the axis of the heating roller for various different widths, or to change the heating length in the circumferential direction of the heating roller to an extent required to more optimally utilize heat generated in the roller.

SUMMARY OF THE INVENTION

It is an object of the present invention to overcome the foregoing shortcomings.

It is also an object of the present invention to provide a fixing device capable of having a wide variety of different heating areas in the heating roller, by changing a width of the heating area in the direction of the axis of the heating roller, and by changing a length of the heating area in the circumferential direction of the heating roller.

It is another object of the present invention to provide a fixing device which can variably control the heating area of a heating roller, and thereby save electrical energy.

It is yet another object of the present invention to provide a heating roller in which it is possible to control the temperature of the heating roller, without requiring a sensor disposed outside of the heating roller.

These and other objects and advantages are achieved in accordance with the present invention by providing a plurality of selectively operable heating elements, preferably in the form of heater chips. The heater chips are selectively supplied with electrical power, such that only chips in an area required for fixing are supplied with power, thereby reducing or eliminating the waste of electrical power associated with heating of areas which are not required for fixing of an image. The selective use of the heater chips within the heating roller also allows for improved temperature control, even within the area for which heating is desired, for example, by varying the number or the density of chips within a given area which are supplied with electrical power.

BRIEF DESCRIPTION OF THE DRAWINGS

A more complete appreciation of the present invention and many of the attendant advantages thereof will become readily apparent from the following detailed description, particularly when considered in conjunction with the drawings in which.

DESCRIPTION OF THE PREFERRED EMBODIMENTS

Figure 3:
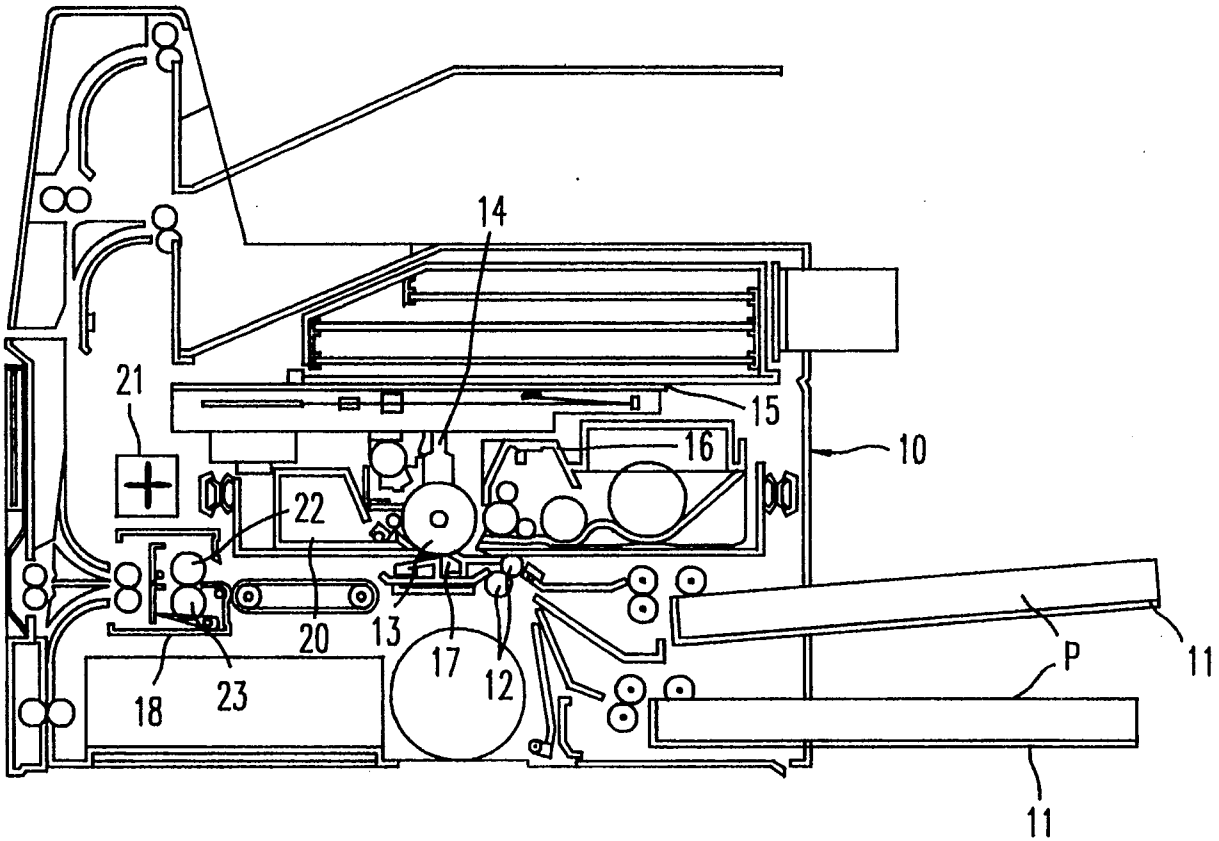
FIG. 3 is a cross-sectional view of a printer employing the present invention.

The present invention will now be described with reference to the accompanying drawings, wherein like reference numerals designate identical or corresponding parts throughout the several views. FIG. 3 is an example of a printer employing the present invention. In this arrangement, paper P is fed from a feeding cassette 11 installed in a printer body 10, with the paper fed toward a photoconductive drum 13 through a resisting roller 12 by which the paper P is synchronized with a rotational speed of the photoconductive drum 13. The photoconductive drum 13 is rotated clockwise by a motor (not shown in the figures), and is provided with a uniform electrical charge on a periphery thereof by a discharging device 14, and exposed by a laser beam from a laser optical device 15 to form an electrostatic image on the photoconductive drum 13. The electrostatic latent image is visualized or developed when it passes a developing device 16, with the image transferred by a transfer charger 17 to a paper sheet P fed from a feeding cassette 11. The image is then fixed to the paper by a fixing device to which the present invention is directed.

After the image is fixed on the paper, the paper sheet P is discharged, for example onto a tray disposed above the printer body 10. After the visual image is transferred to the sheet of paper P, toner remaining on the drum 13 is wiped by a cleaning device 20 in preparation for the next copying operation. Air in the printer body 10 is ejected or exhausted by an exhaust fan 21 to the outside of the printer. The fixing device 18 is composed of a heating roller 22 and a pressing roller 23, and fixes a toner image on the paper sheet P with heat and pressure while clamping it between the rollers 18, 22.

Figure 1:
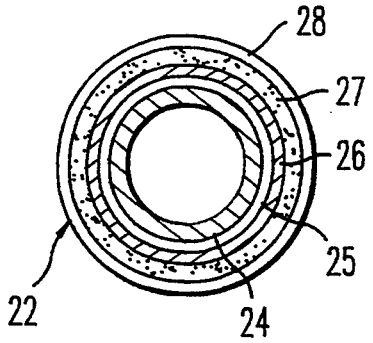
FIG. 1 is a side cross-sectional view of a heating roller of the present invention showing the inside of the heating roller.
Figure 2:
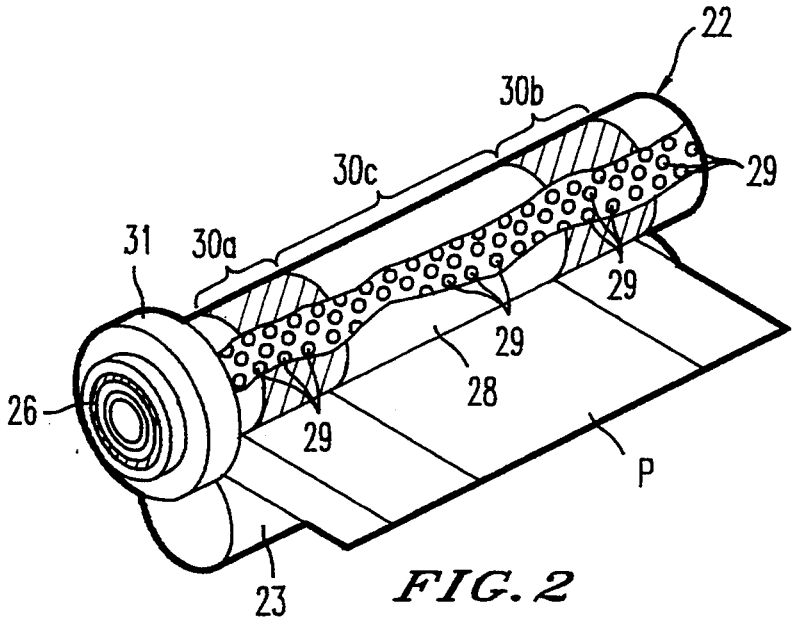
FIG. 2 is a perspective and partly cut away view of a heating roller of the present invention showing a heating area of the heating roller which includes a plurality of heater chips.

FIG. 1 is a side cross-section depicting the structure of a heating roller 22 of the present invention, with FIG. 2 a partial cut away view of the same roller. The heating roller 22 includes a tube-form member or support cylinder 24 made of a metal, an inner insulating layer 25 disposed about a periphery of the cylindrical or pipe-shaped member 24, and an electric power supplying layer 26 disposed about the periphery of the inner insulating layer 25. In addition, a heating layer 27 overlies the periphery of the electric power supplying layer, and an outer insulating layer 28 is disposed on the outer periphery of the heating layer 27, so that each of the layers are concentrically disposed. The heating layer 27 includes a plurality of heater chips thereon, each of which is insulated so that they are independently supplied with power and thereby heated. The power supplying layer 26 includes a printed board arrangement or printed circuit, on which electrical wires are printed, with the wires connected to each of the heater chips so that the heater chips can be supplied with power individually, or together with other heater chips. Thus, the selected heater chips or selected groups of heater chips can be supplied with power as desired.

This fixing device 18 can be controlled in the following manner due to the structure provided for the heating roller 22. For example, where no image is to be fixed onto a sheet corresponding to the edge portions of the roller, the heater chips 29 on both of the edge portions **30*a*, 30*b* of the heater roller 22 are not supplied with power, and only the heater chips on the central part 30*c*** are supplied with power. As a result, the energy expended for fixing of a small-sized image is decreased substantially, and the amount of energy required can be decreased in proportion to the size of the image area of the paper sheet.

Figure 4A:
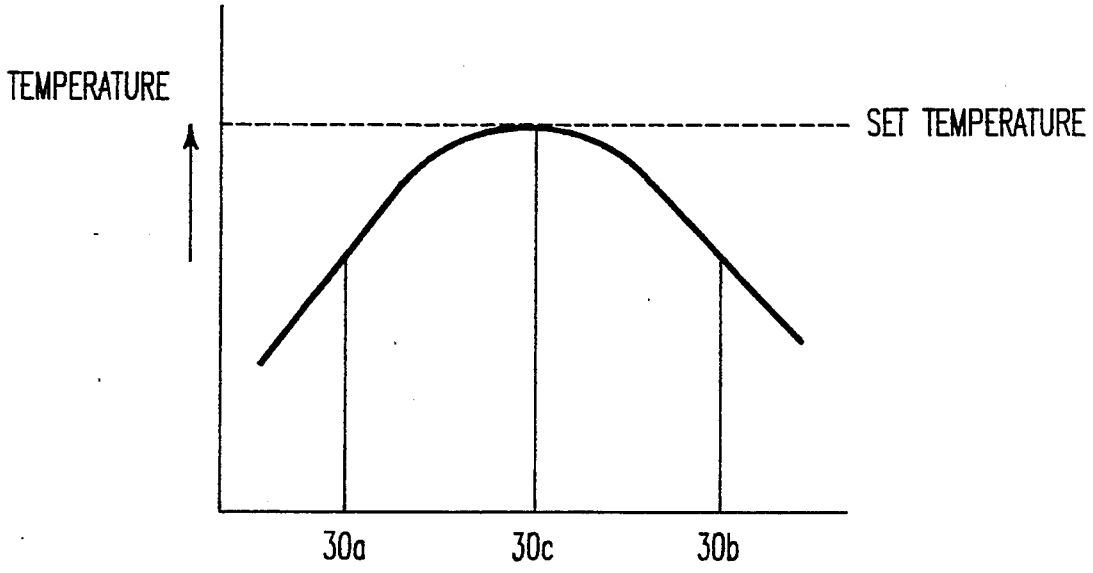
FIGS. 4A and 4B are graphs showing temperature distributions along the axis of the heating roller.
Figure 4B:
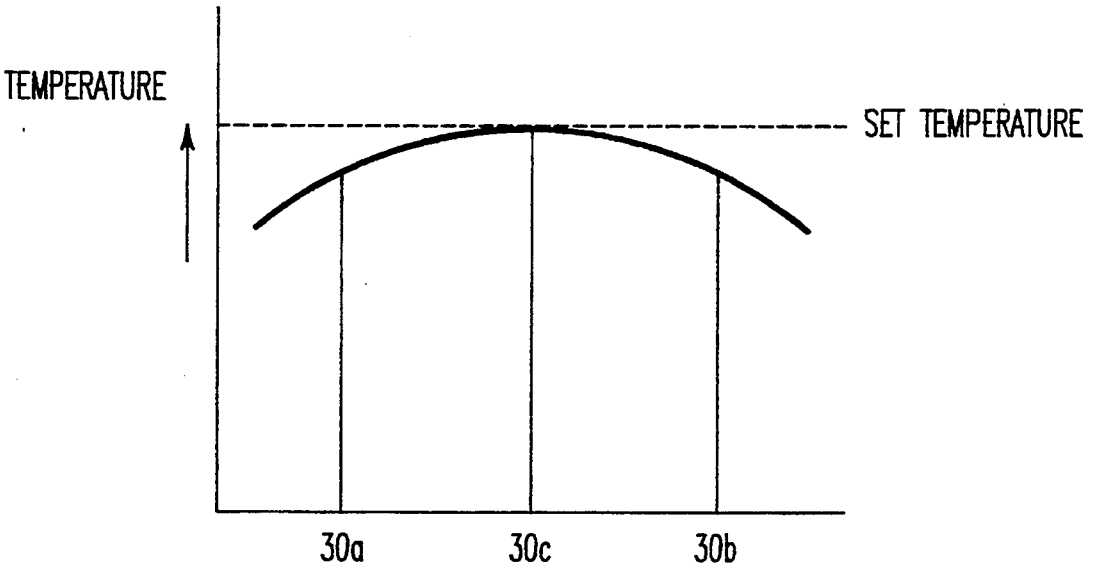

In the situation where the temperature distribution of the heater roller 18 varies such that at the beginning of the consecutive fixing, the temperature of both of the side edges is relatively low, and the central part thereof is high, due to the leakage of heat through a support member 31 of the heater roller 22 (see, e.g., FIG. 4A). Thereafter, as the temperature distribution becomes flat or more uniform when the consecutive fixing has been performed (FIG. 4B), another control can be utilized as follows. In particular, some or all of the heater chips on both of the side edges of the heater roller 18 are initially supplied with power, and thereafter gradually decreased numbers of the heater chips per unit area are supplied with power according to the progress of the consecutive fixing operations. As a result, the cost of supplying electric power to the heater roller can be reduced by avoiding the needless maintenance of a high temperature of all of the heater chips on the heater roller 22 during the consecutive fixing, and the quality of the fixing of the toner image on the paper is efficiently improved.

Figure 5:
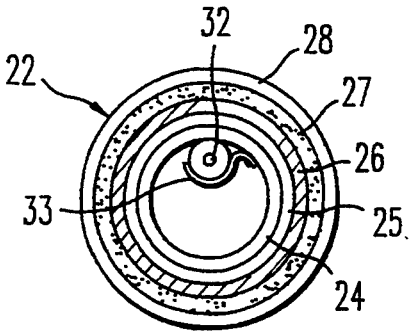
FIG. 5 is a side cross-sectional view of a heating roller showing a sensor contacting an inside surface thereof.

The temperature of the inner surface of the heater roller 22, namely the base material 24, is almost the same as that of the outer periphery thereof. This is because the insulating layers 25 and 28 are disposed in contact with both the outer periphery and inner periphery of the heating layer 27, and further, the base material 24 is made of a metal which functions to collect heat. Therefore, a temperature fuse 32 can rapidly react at the time the temperature of the heater roller 22 has reached a predetermined level if the fuse 32 is pressed directly against the base material 24 by a plate spring 33 as shown in FIG. 5. Thus, the internal temperature fuse 32 can be utilized to monitor/control the temperature of the roller, without requiring outer peripheral sensors.

Figure 6:
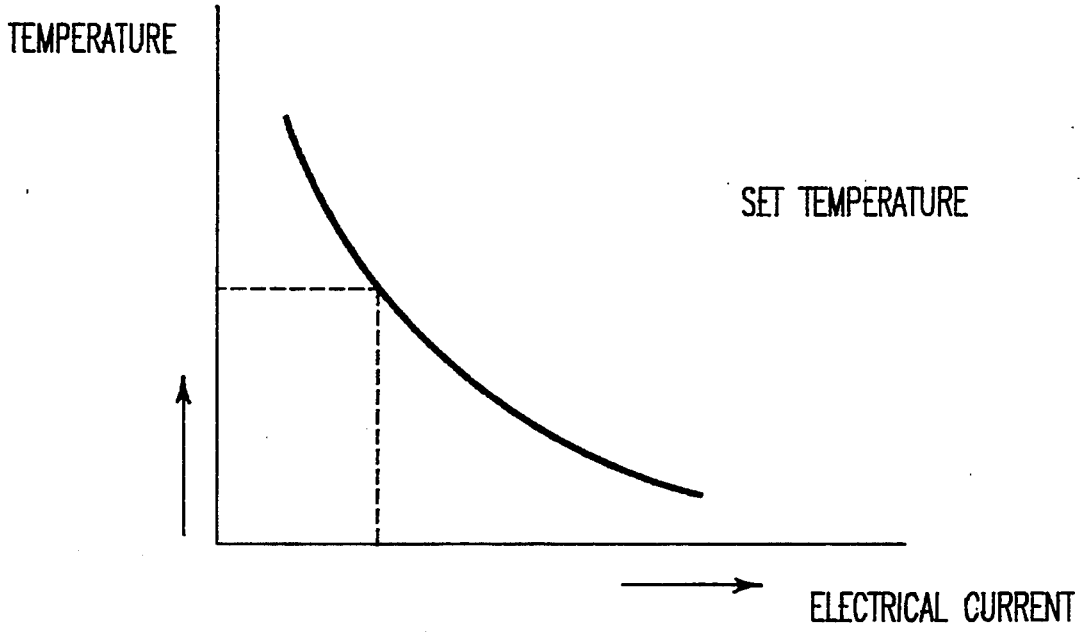
FIG. 6 is a graph showing changes in the electrical current in a heater chip depending on changes in the temperature of the heating roller.
Figure 16:
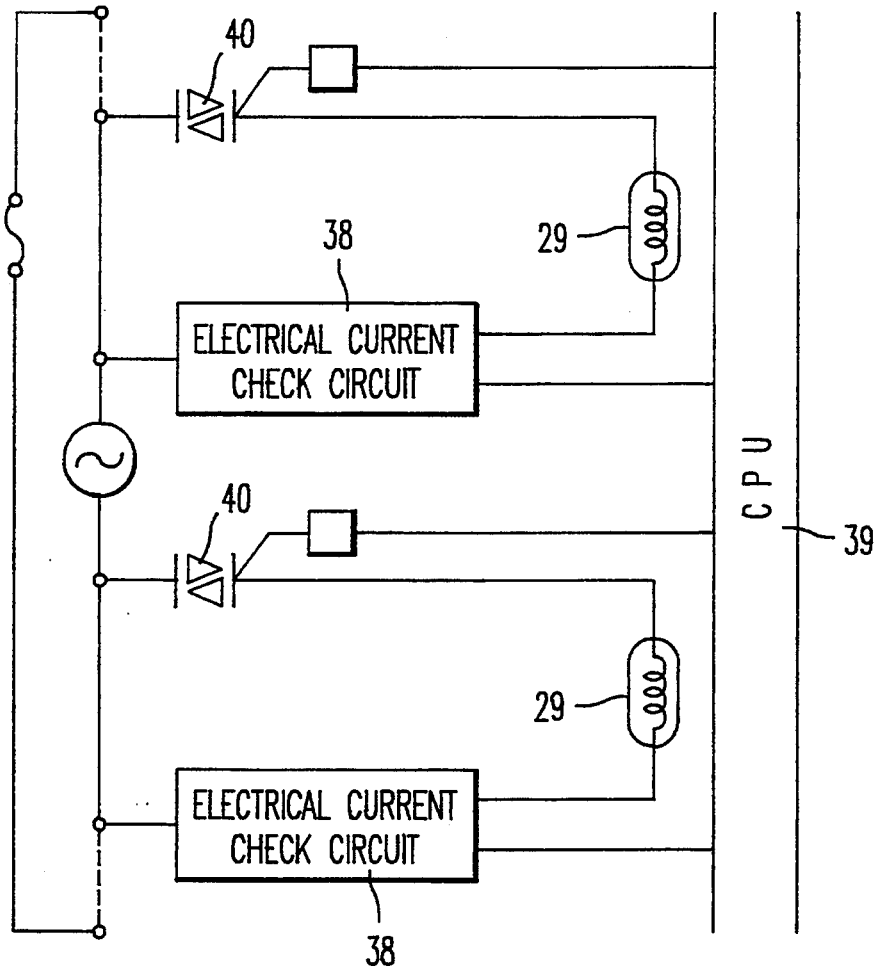
FIG. 16 is a schematic diagram of a control arrangement for controlling the current in the heater chips.
Figure 17:
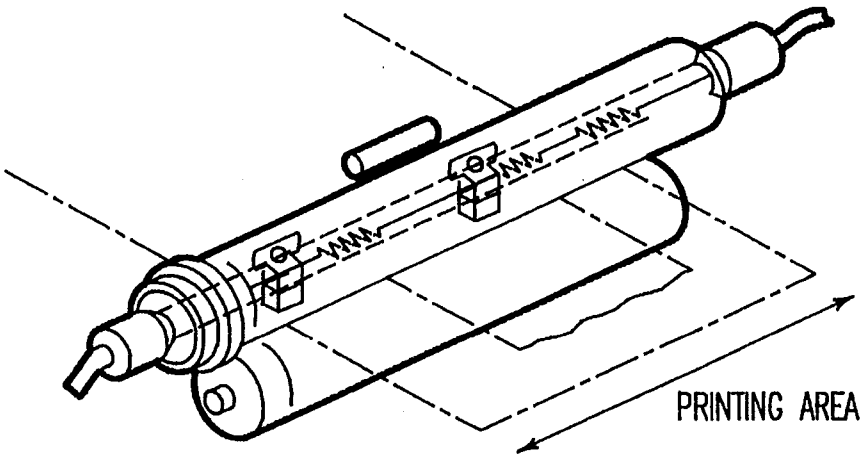
FIG. 17 PRIOR ART
FIG. 17 is a perspective view of a conventional heating roller.

The electrical resistance of the heater chips 29 vary in accordance with changes in the temperature thereof as shown in FIG. 6, so that the amount of current in the power supplying part 26 of the heater chips 29 varies accordingly. Therefore, the temperature of the heating roller 22 can be automatically achieved without utilizing a particular temperature sensor disposed outside of the heater roller, with a current check circuit 38 connected to a power-supplying circuit as shown in FIG. 16. As shown in FIG. 16, the current check circuit thus determines the current to (or through) the heater chip 29, and the temperature of the heater roller 22 can thus be calculated by a CPU 39 based upon the result of the current check, with the relationship of current and temperature known and stored in the CPU. The ON/-OFF switching of the heater chips 29 can thus be controlled by a relay 40 in accordance with the result of the current check.

Figure 7:
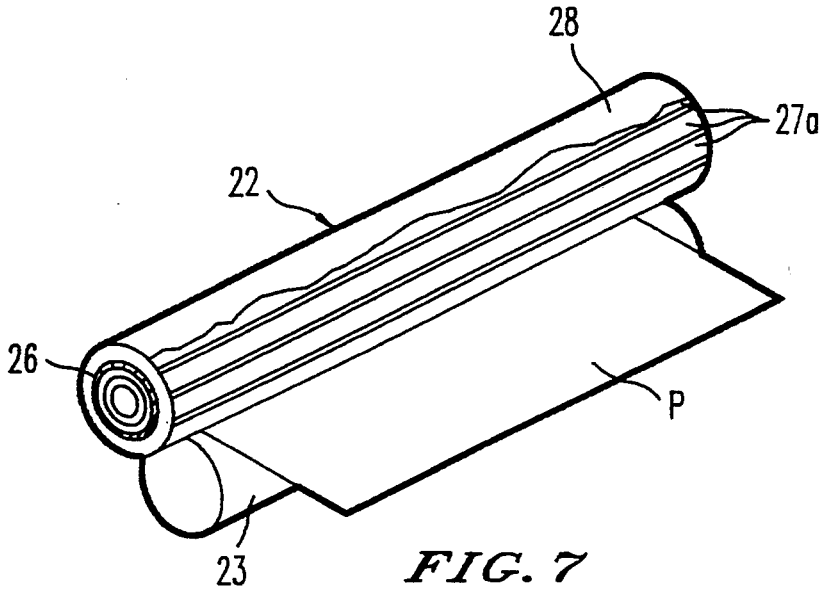
FIG. 7 is a perspective and partly cut away view of another heating roller having a heating layer which is split into plural parts extending parallel to the axis of the heating roller.
Figure 8:
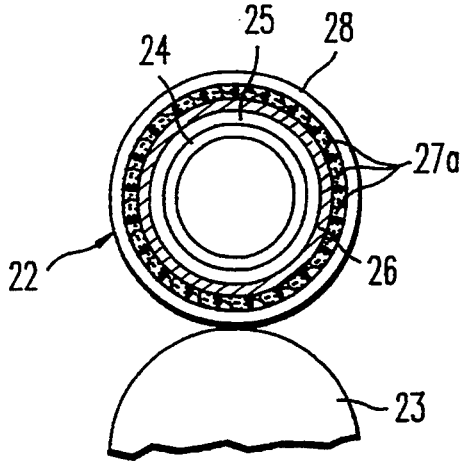
FIG. 8 is a side cross-sectional view of a heating roller as shown in FIG. 7.

As shown in FIGS. 7 and 8, the heating layer 27 which includes the heater chips 29 can be divided into plural parts in the circumferential direction of the heater roller 22, by disposing insulating parts therebetween so that plural heating lines 27*a* are disposed parallel with each other, with the lines 27*a* extending parallel to the axis of the heating roller. Each line 27*a* is selectively supplied with power, alone or in combination with other lines. With this arrangement, an interval between a warming up stage and an operating stage of the machine can be effectively minimized and the cost of supplying electric power is thereby reduced, since one of the heating lines 27*a* which contacts the pressure roller 23 can be supplied with power during the warming up stage, with the pressure roller 23 thereby kept hot by the heating line 27*a*. Thus, not all of the lines need to be supplied with power in order to warm the pressure roller 23, resulting in energy savings. Further, by selectively heating the lines 27*a*, the length of the heated area (in the circumferential direction of the heater roller) can be varied according to the size of the sheet, or the size of the image area. Moreover, if the lines or elements which include the heater chips 29, are relatively small, if desired, by only heating selected proportions of the lines within a heated area, the temperature can be controlled, while reducing the energy requirements.

Figure 9:
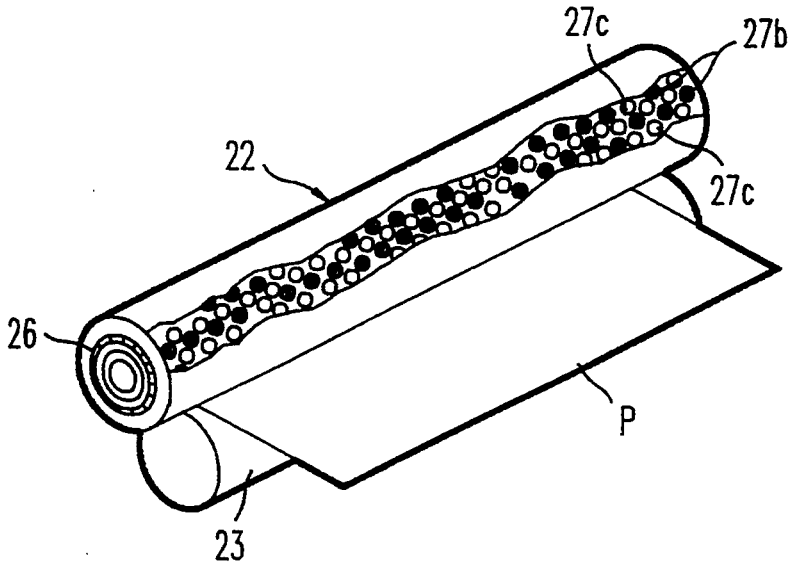
FIG. 9 is a perspective and partly cut away view of still another heating roller showing the heater chips being supplied with electrical power selectively.
Figure 10:
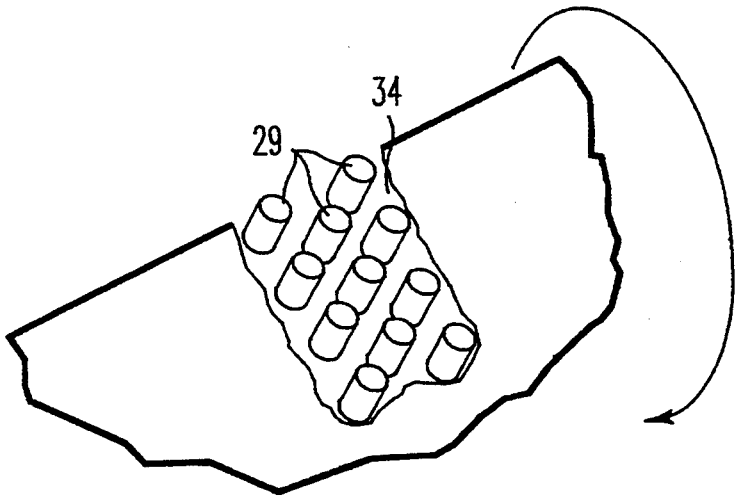
FIG. 10 is a partial perspective view of the heating roller having heater chips disposed in an alternating or staggered arrangement.

If the paper sheet P being fixed is relatively thin, the heat absorbed by the paper sheet P from the heater roller 22 is relatively small and only a small amount of electric power to the heater roller 22 is sufficient to fix the image on the paper sheet P. By contrast, where the paper P is rather thick, a relatively large amount of electric power to the heater roller 22 is required. In this case, a high quality fixing of the paper P is obtained regardless of the thickness of the paper sheet P, if only the heater chips 27*b*, which extend along lines in the direction of the axis of the heater roller 22 are energized as shown in FIG. 9 for fixing of an image upon a thin paper P. By contrast, all of the heater chips, or a greater number of the heater chips, including the chips 27*b* and 27*c* are energized for fixing an image on a thicker paper P. Thus, the number of chips being energized can be varied to accommodate varying paper thicknesses in order to insure high quality fixing of images, while conserving energy. Accordingly, by varying the number of chips which are supplied with power, the amount of heat generated in the roller can be varied even within the image area or heated area, and further, non-image areas need not be supplied with power to thereby further save energy. Still further, by providing heater chips 29 which are insulated from each other, and disposed alternately, or staggered, in the direction of the circumference of the heater roller 22 as shown in FIG. 10, the distribution of the temperature thereof in the direction not only parallel to the axis of the heater roller 22, but also in the circumferential direction, is uniform and a uniform temperature control is thus obtained.

Figure 11:
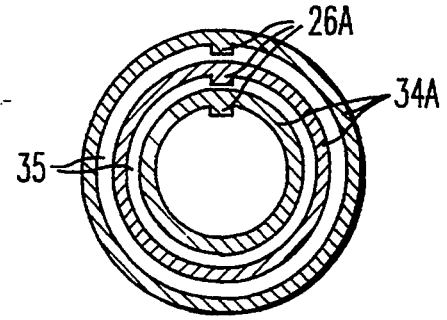
FIG. 11 is a cross-sectional view of the heating roller showing the electrical supply layers having insulating layers inserted therebetween.
Figure 12:
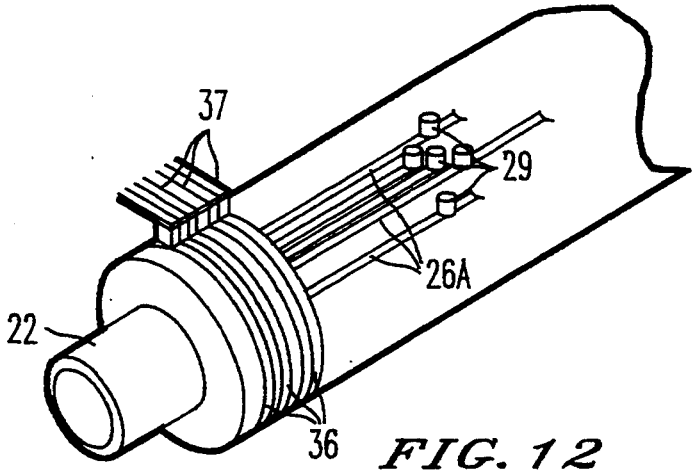
FIG. 12 is a perspective and partly cut away view of the heating roller showing electricity supplying devices or couplings to the heater chips.
Figure 13:
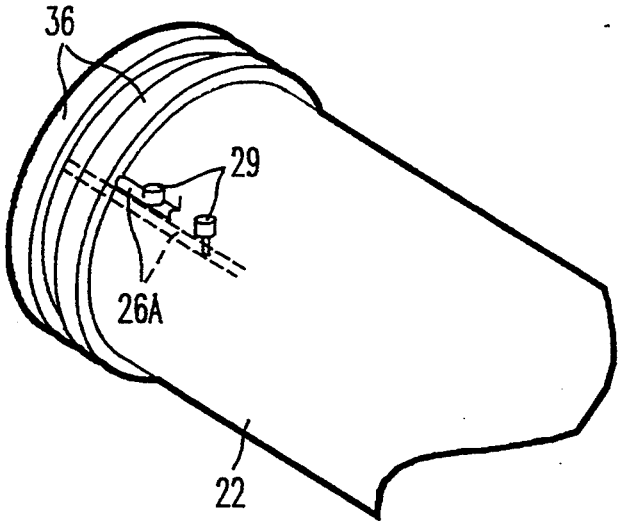
FIG. 13 is an enlarged perspective view showing a connecting ring of the electrical supply layer and the heater ships.

As shown in FIGS. 11–13, a plurality of power supplying layers 26 can be disposed spaced in the radial direction of the heater roller 22, with the insulating layers 35 inserted therebetween. In this arrangement, both of the side edges of the power supplying layers 26 are interconnected to connecting parts 36, which are disposed at both side edges of the heater roller 22, with the connectors or connecting parts 36 shaped as a ring and insulated from each other. With the rings disposed on each end of the roller, the rings on one side or one edge can be utilized as a positive terminals, with the rings on the other edge utilized as negative or ground terminals. The connector rings are disposed parallel to each other, and connected with a respective power supplying layer 26 correspondingly. Each of the connecting parts 36 is pressed upon by respective power supply brushes 37 with a predetermined pressure such that the connecting parts 36 are individually supplied with electric power from a power source (not shown in the figures). Further, each of the power supplying layers 26 is divided by thin insulating layers 34*a*, such that the power supplying layers 26 include separate lines or belts 26*a* disposed parallel to the axis of the heater roller 22. Thus, the power supplying layers 26 provide connecting lines 26*a* to connect the rings 36 to the heater chips 29, with the layers 26 separated by the insulating layers 35, and lines 26*a* within a layer can be insulated by the thin insulating layers 34*a*.

Although the FIG. 11 arrangement shows a single line 26*a* for each layer to simplify the description thereof, it is to be understood that plural lines can be disposed for each layer as desired. Further, the lines are not required to be aligned as shown in FIG. 11, however the arrangement shown in FIGS. 11 and 13 demonstrates that different chips which are aligned in an axial direction of the roller need not be heated together, but may be individually supplied with power as desired. For example, as shown in FIG. 13, the heater chip disposed adjacent the edge of the roller 22 can be supplied with power by one of the connector rings 36, while the other heater chip is supplied with power by another heater ring. Thus, the area to be heated in a width-wise direction can be varied by selecting the brushes (and thus the corresponding ring connectors) to be supplied with power. Further, depending upon the connection of the chips with the respective rings, the area to be heated in the length-wise direction (in the circumferential direction of the roller) can also be varied based upon the selection of the brushes 37 and thus the rings 36 to be supplied with power. Moreover, if desired, the density of heated chips even within an area to be heated can also be varied as was discussed earlier with reference to FIG. 9.

Thus, the heater chips 29 can be connected to the lines or belts 26*a* to be supplied with power individually, or in selected groups.

With the arrangement shown in FIGS. 11–13, each of the heater chips 29 aligned in parallel to the axial direction of the heater roller 22 can thus be connected to different power supply lines 26, which are disposed coaxially (FIG. 11) in order to avoid interference in the supply of electric power between the adjacent chips 29. Also, each of the heater chips 29 aligned along the circumferential direction of the heater roller 22 on the surface thereof can be connected to different lines 26*a* of a same power supplying layer 26, each of which are divided by the insulating layer 35 to avoid interference or shorting of the electric power supply among adjacent chips 29.

Thus, with the arrangement of FIGS. 11–13, the heated area can be varied in both the width and length directions by selecting the rings which are supplied with power by the brushes, or if desired, the variation in the heated area can be provided in only one direction. Further, if desired, the number of chips within the heated area can be varied to thereby vary the amount of heating or the temperature of the roller. In addition, a control circuit can be utilized to control the temperature as discussed earlier with reference to FIG. 16.

Figure 14:
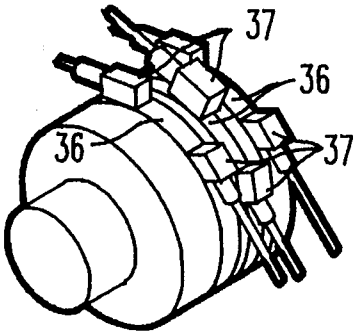
FIG. 14 is a perspective view showing two brushes contacting each of the contact or connector parts for each electrical supply layer.

Preferably, the plurality of power supply brushes 37 are pressed into contact with the connecting parts or connecting rings 36 as shown in FIG. 14, with more than one brush provided for each of the rings. This arrangement is preferred since, if only a single brush 37 is utilized as shown in FIG. 12, vibration in the periphery of the connecting parts 36, which can be caused by unevenness of the connecting parts or vibration of the roller, the brushes can temporarily lose contact with the respective rings, and electrical leakage can occur. However, by providing two or more brushes 37, the leakage or failure to achieve contact is avoided, since the brushes 37 are provided at spaced locations, making the possibility that all of the brushes for a given ring would fail to contact quite minimal. Further, in order to avoid a dangerous situation in which two or more adjacent brushes contact one another, particularly where the insulating material disposed between the brushes 37 may be thin, it is preferable to arrange the brushes in a staggered or alternating arrangement as shown in FIG. 14. In particular, as shown in FIG. 14, in the direction parallel to the axis of the heater roller, the adjacent brushes are not aligned with one another, but rather are provided in an alternating staggered arrangement to increase the distance between adjacent brushes.

Figure 15:
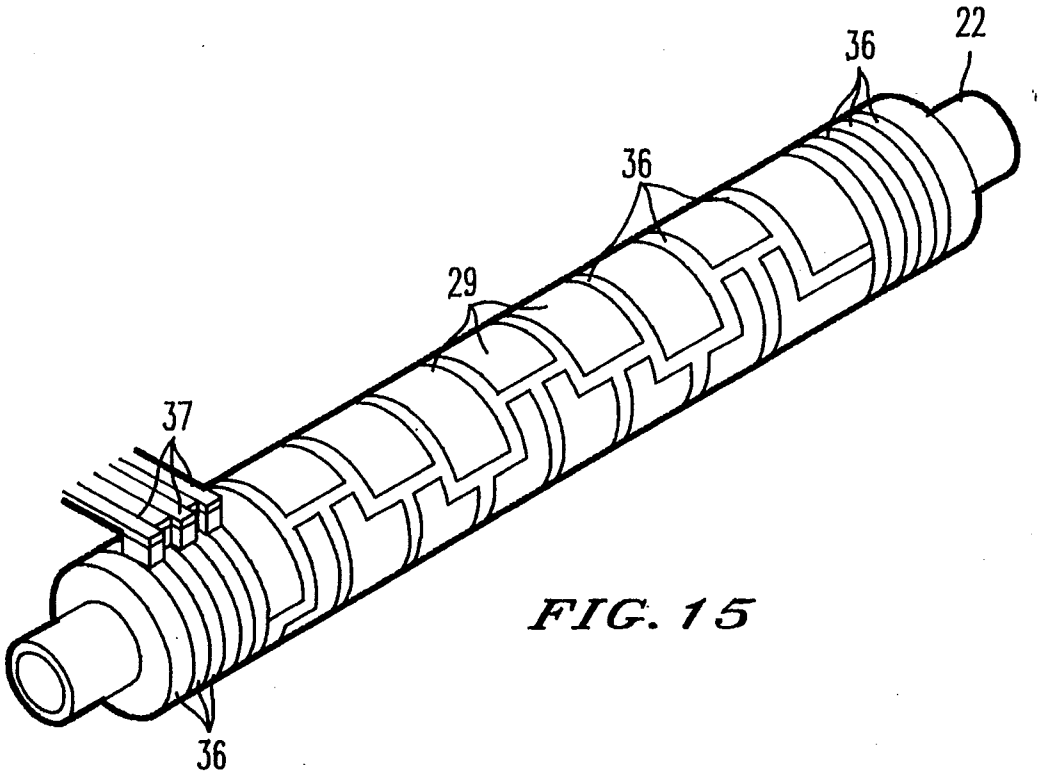
FIG. 15 is a perspective and partly cut away view of still another heating roller showing the heater chips shaped as plates and disposed alternately or in a staggered relation.

In the foregoing embodiments, the heater chips provide individual heater elements, formed, for example, of a ceramic. The invention need not be limited to heater chips shaped as shown in the foregoing figures, and plate-shaped heater elements may also be provided as shown in FIG. 15. As shown in FIG. 15, the plate-like chips 29 can be provided, with a mesh-form or web-like insulating member 34, such that the heater chips 29 are insulated by the insulating parts 34. With this arrangement, it is preferable to arrange the plates in an alternating or staggered relation in both the axial and circumferential directions to improve the consistency or uniformity of the heating, thereby avoiding continuous lines of unheated areas. Thus, utilizing the staggered plate arrangement insufficient fixing, which can be caused by localized low temperature portions, is avoided.

As should be readily apparent from the foregoing, the present invention provides improved flexibility with respect to the supply of heat or the generation of heat in a fixing roller. As a result, improved fixing can be achieved, since the roller can be more readily controlled with respect to the image area and/or the type of paper upon which an image is to be fixed. Further, energy is saved, since areas of the roller which do not require heating need not be supplied with power during a fixing operation, as well as during the initial warm-up period.

Obviously, numerous modifications and variations of the present invention are possible in light of the above teachings. It is therefore to be understood that within the scope of the appended claims, the invention may be practiced otherwise than as specifically described herein.

What is claimed and new and desired to be secured by Letters Patent of the United States is:

1. A fixing roller device comprising:

a fixing roller;

a heating layer disposed in said fixing roller, said heating layer including a plurality of heater chips extending both in a circumferential direction and in a direction parallel to an axis of the fixing roller; and an electric power supply layer connected to at least one of the chips for selectively supplying electric power to said at least one of the chips;

wherein the power supply layer includes a printed circuit.

2. The fixing roller device of claim 1, wherein at least one heater chip is provided along a line extending in a circumferential direction of the fixing roller, and further wherein at least one heater chip is provided along a line extending in a direction parallel to the axis of the fixing roller.

3. A fixing roller device comprising:

a fixing roller;

a heating layer disposed in said fixing roller, said heating layer including a plurality of heater chips extending both in a circumferential direction and in a direction parallel to an axis of the fixing roller; and an electric power supply layer connected to at least one of the chips for selectively supplying electric power to said at least one of the chips;

wherein a temperature fuse is disposed inside of said fixing roller, with the temperature fuse pressed directly against an inner surface of a cylindrical tube member of said fixing roller.

4. A fixing roller device comprising:.

a fixing roller;

a heating layer disposed in said fixing roller, said heating layer including a plurality of heater chips extending both in a circumferential direction and in a direction parallel to an axis of the fixing roller; and an electric power supply layer connected to at least one of the chips for selectively supplying electric power to said at least one of the chips;

wherein the heating layer is divided by insulating members into a plurality of insulated heating bands, with each of the heating bands extending in a direction parallel to an axis of the fixing roller, and each of the plurality of heating bands is independently supplied with electrical power.

5. A fixing roller device comprising:

a fixing roller;

a heating layer disposed in said fixing roller, said heating layer including a plurality of heater chips extending both in a circumferential direction and in a direction parallel to an axis of the fixing roller; and an electric power supply layer connected to at least one of the chips for selectively supplying electric power to said at least one of the chips;

wherein each of the heater chips are insulated from each other, with the heater chips disposed in a staggered relation in a circumferential direction of the fixing roller.

6. A fixing roller device comprising:

a fixing roller;

a heating layer disposed in said fixing roller, said heating layer including a plurality of heater chips extending both in a circumferential direction and in a direction parallel to an axis of the fixing roller; and an electric power supply layer connected to at least one of the chips for selectively supplying electric power to said at least one of the chips;

wherein a plurality of power supply layers are provided which are arranged concentrically at different radial positions of the fixing roller.

7. The fixing roller device of claim 6, wherein a plurality of ring connectors are provided for supplying power to each of the respective power supply layers, and wherein a plurality of power supplying brushes are disposed in contact with the ring connectors.

8. The fixing roller device of claim 7, wherein the plurality of ring connectors are provided at each end of the fixing roller, and wherein the ring connectors of one end are provided as positive terminals, with the ring connectors of another end provided as negative terminals.

9. The fixing roller device of claim 7, wherein each of the ring connectors are insulated from each other by insulating members and each of the brushes are disposed in a staggered relation in a direction parallel to the axis of the fixing roller such that adjacent brushes are not aligned with one another in the axial direction of the fixing roller.

10. A fixing roller device comprising:

a fixing roller;

a heating layer disposed in said fixing roller, said heating layer including a plurality of heater chips extending both in a circumferential direction and in a direction parallel to an axis of the fixing roller; and an electric power supply layer connected to at least one of the chips for selectively supplying electric power to said at least one of the chips;

the device further including a current check means for checking the current passing through the heater chips, to thereby provide a temperature control for the fixing roller.

11. A fixing roller device having a fixing roller, said fixing roller comprising:

a cylindrical base tube;

an inner insulating layer disposed about the cylindrical base tube;

a power supply layer disposed above the inner insulating layer;

a heating layer disposed above the power supply layer; and an outer insulating layer disposed above the power supply layer.

12. The fixing roller device of claim 11, wherein the power supply layer includes a printed circuit.

13. The fixing roller device of claim 11, wherein a temperature fuse is disposed inside of said fixing roller, with the temperature fuse pressed directly against an inner surface of the cylindrical base tube of said fixing roller.

14. The fixing roller device of claim 11, wherein the heating layer is divided by insulating members into a plurality of insulated heating bands, with each of the heating bands extending in a direction parallel to an axis of the fixing roller, and each of the plurality of heating bands is independently supplied with electrical power.

15. The fixing roller device of claim 11, wherein a plurality of heater chips are provided in said heating layer, wherein said heater chips are insulated from each other, with the heater chips disposed in a staggered relation in a circumferential direction of the fixing roller.

16. The fixing roller device of claim 11, wherein a plurality of power supply layers are provided which are arranged concentrically at different radial positions of the fixing roller.

17. The fixing roller device of claim 16, wherein a plurality of ring connectors are provided for supplying power to each of the respective power supply layers, and wherein a plurality of power supplying brushes are disposed in contact with the ring connectors.

18. The fixing roller device of claim 17, wherein the plurality of ring connectors are provided at each end of the fixing roller, and wherein the ring connectors of one end are provided as positive terminals, with the ring connectors of another end provided as negative terminals.

19. The fixing roller device of claim 17, wherein each of the ring connectors are insulated from each other by insulating members and each of the brushes are disposed in a staggered relation in a direction parallel to the axis of the fixing roller such that adjacent brushes are not aligned with one another in the axial direction of the fixing roller.

20. The fixing roller device of claim 15, wherein at least one heater chip is provided along a line extending in a circumferential direction of the fixing roller, and further wherein at least one heater chip is provided along a line extending in a direction parallel to the axis of the fixing roller.

21. The fixing roller device of claim 11, further including a current check means for checking the current passing through the power supply layer, to thereby provide a temperature control for the fixing roller.

* * * * *